United States Patent [19]

du Plessis

[11] Patent Number: 4,633,785

[45] Date of Patent: Jan. 6, 1987

[54] HOPPERS AND BOGIES

[75] Inventor: Gysbert J. du Plessis, Potchefstroom, South Africa

[73] Assignee: Rotaque (Proprietary) Limited, Potchefstroom, South Africa

[21] Appl. No.: 679,751

[22] Filed: Dec. 10, 1984

[30] Foreign Application Priority Data

Dec. 22, 1983 [ZA] South Africa ..... 83/9569

[51] Int. Cl.[4] ..... B61F 3/00

[52] U.S. Cl. ..... 105/176; 105/241.1; 105/199.1; 105/4.1

[58] Field of Search ..... 105/3, 4 R, 4 A, 165, 105/167, 168, 176, 182 R, 199 R, 200, 241.1, 241.2, 364, 189, 226; 180/14.1; 280/408

[56] References Cited

U.S. PATENT DOCUMENTS

| | | | |
|---|---|---|---|
| 340,206 | 4/1886 | Furrell | 105/364 |
| 2,989,930 | 6/1961 | Flowers | 105/241.1 |
| 3,582,110 | 6/1971 | Bryan, Jr. | 105/3 |
| 3,790,008 | 2/1974 | Joubert | 105/241.1 |
| 3,961,582 | 6/1976 | Paton et al. | 105/176 |
| 4,337,707 | 7/1982 | Brouwer | 105/176 |
| 4,353,312 | 10/1982 | Brouwer | 105/241.2 |
| 4,458,911 | 7/1984 | Chadwick et al. | 105/3 |
| 4,480,954 | 11/1984 | Manstrom | 105/241.2 |

FOREIGN PATENT DOCUMENTS

| | | | |
|---|---|---|---|
| 955242 | 1/1957 | Fed. Rep. of Germany | 105/176 |
| 3224306 | 1/1984 | Fed. Rep. of Germany | 105/241.2 |
| 4114 | of 1911 | United Kingdom | 105/241.2 |

*Primary Examiner*—Robert B. Reeves
*Assistant Examiner*—Dennis C. Rodgers
*Attorney, Agent, or Firm*—Fitch, Even, Tabin & Flannery

[57] ABSTRACT

A bottom discharge hopper rail car train includes a pair of hopper rail cars each having a hopper body mounted on a chassis. Adjacent ends of the two hopper rail cars are supported by a split bogie assembly having bogie parts each pivotally mounted at an end region of a respective rail car and each including a pair of flanged wheels rotatable about a common axis. In this invention, the bogie parts are mounted adjacent to one another and each have formations for co-operating with complementary formations on the other bogie part for co-operating movement of the bogie parts of the assembly with respect to one another when the assembly moves along a curved track. The invention also extends to a split bogie assembly.

9 Claims, 8 Drawing Figures

HOPPERS AND BOGIES

This invention relates to bottom discharge hoppers and bogies.

The provision of a composite wheel and axle assembly, herein called a bogie assembly, in the region of the coupling between two rail cars is known (RSA Pat. No. 82/7464 based on now U.S. Ser No. 3 17 305) now U.S. Pat. No. 4,454,821. The arrangements do not always provide for easy coupling and separation of the rail cars, but are intended to provide a flexible assembly to reduce forces on wheels negotiating curves, and this purpose may take priority over ease of coupling.

In South African Pat. No. 76/6459, there is disclosed a structure for coupling two vehicles in which two bogie parts are mounted beneath respective car bodies and can be rigidly connected to form a composite bogie assembly. This arrangement provides an ease of coupling not present in South African Pat. No. 82/7464 but lacks the flexibility in the resulting assembly.

It is therefore desirable to provide a bogie assembly which has flexibility but need not hamper coupling of the rail cars.

The present invention provides a split bogie assembly having bogie parts each pivotally mounted at an end region of a respective rail car and each including a pair of flanged wheels rotatable about a common axis, the bogie parts being mounted adjacent to one another and each having means for co-operating with complementary means on the other bogie part for co-ordinating movement of the bogie parts of the assembly with respect to one another at least when the assembly moves along a suitable curved track, in use.

The present invention also provides a bottom discharge hopper rail car train including at least two hopper rail cars each having a hopper body mounted on a chassis, adjacent ends of said two hopper rail cars being supported by a split bogie assembly having bogie parts each pivotally mounted at an end region of a respective rail car and each including a pair of flanged wheels rotatable about a common axis, the bogie parts being mounted adjacent to one another and each having means for co-operating with complementary means on the other bogie part for co-ordinating movement of the bogie parts of the assembly with respect to one another at least when the assembly moves along a suitable curved track, in use.

The body may have transversely and longitudinally extending edges which border a discharge opening from the body, the opening being wholly or substantially wholly at a level below the tops of the wheels but above the bottoms of the wheels.

Each bogie part may be pivotally mounted at its respective end region of the respective rail car by means of a bogie saddle and complementary bogie member pivotally associated therewith.

The co-operating means and the complementary co-operating means may each comprise formations at adjacent edge regions of the bogie parts. These formations may, for example, be located towards opposite end portions of those edge regions. Alternatively, the formations may have an arrangement such as a spigot and socket arrangement at a central part of adjacent edge regions of the bogies. In any case, the assembly is to be aimed at reducing hunting when the movement of the wheel sets is co-ordinated.

In order to prevent undue pivoting movement of the bogie parts when they are not co-ordinated with other such parts, suitable locking means may be provided for restricting such movement.

At least one door may be pivotally mounted on the body and displaceable between a closed condition in which said opening is closed by said at least one door, and an open condition to permit discharge of the contents of said body.

The longitudinally extending edges may be at the lower region of a pair of downwardly converging laterally spaced side walls, which may be asymmetrical with respect to a longitudinal vertical plane passing centrally between the wheels. In a preferred form of the invention, both of these longitudinal edges are below the tops of the wheels but are located one above another to allow a single door to be asymetrically mounted on the body.

The distance between the longitudinally extending edges may be greater than the spacing between wheels at opposite sides of the rail car, ie measured in a direction across the width of the car. Furthermore, the distance between the transversely extending edges may be slightly greater than the longitudinal spacing between the wheels at either side of the rail car. To ensure that this does not result in the door striking the wheels when the door moves to its open condition, the door is located and pivoted so that it swings through an arc passing above parts of the wheels during the course of its movement.

The chassis may be formed wholly or primarily by a chassis frame supporting the body and, to provide for the use of a relatively long opening in relation to the length of the chassis, the wheels may be located as close as is reasonably possible to the end of the chassis frame, for example project beyond the ends of the chassis frame.

An embodiment of the present invention will now be described, by way of example, with reference to the accompanying drawings, in which FIG. 1 is a partial side elevation of two bottom discharge hopper rail cars in a train;

Figure 1:
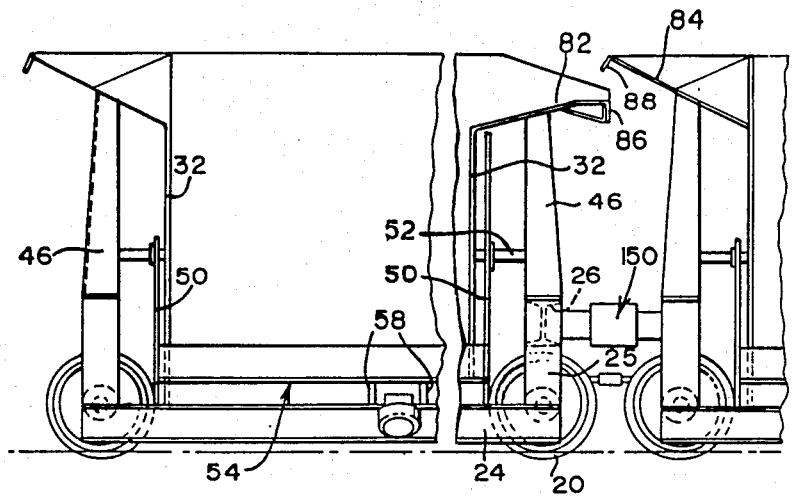
Figure 2:
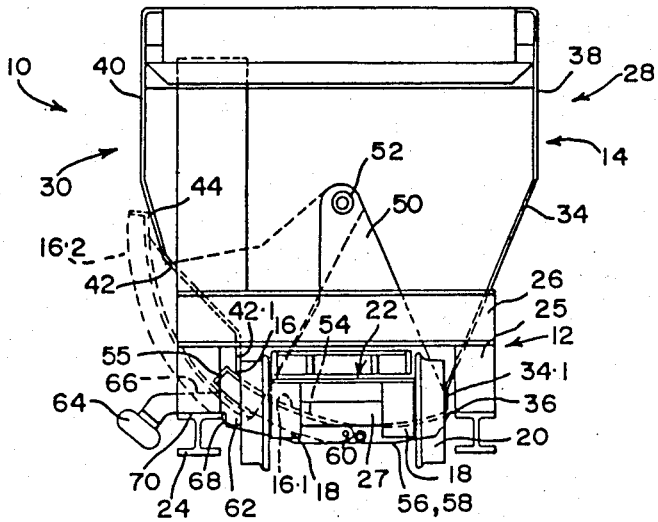
FIG. 2 is an end elevation of a hopper car of FIG. 1.
Figure 3:
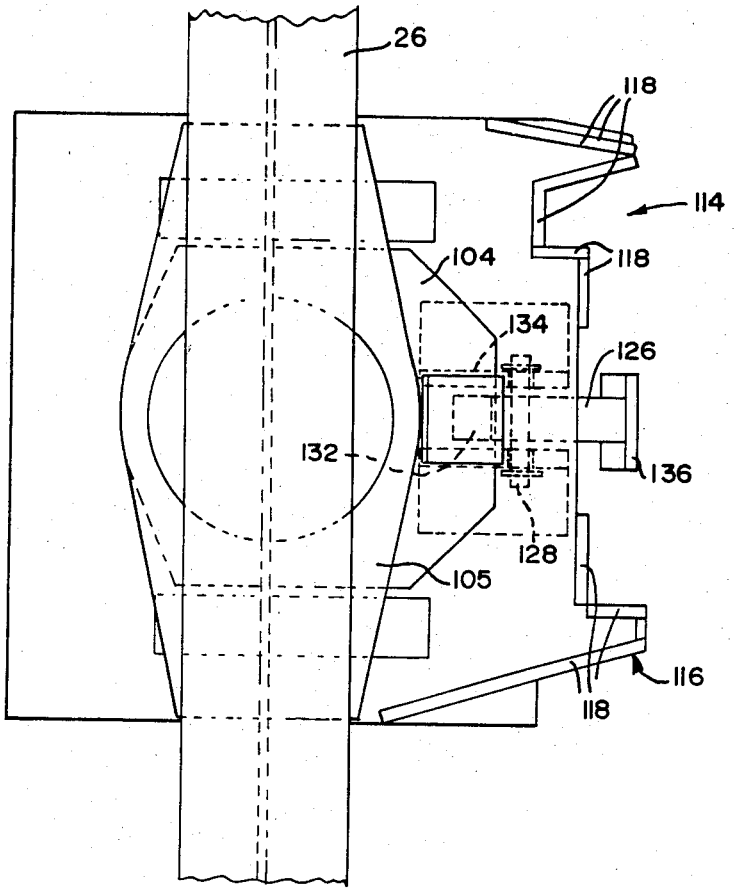
FIG. 3 is a schematic plan view of an upper portion of a split bogie part at an end region of one of the two hopper cars shown in FIGS. 1 and 2.
Figure 4:
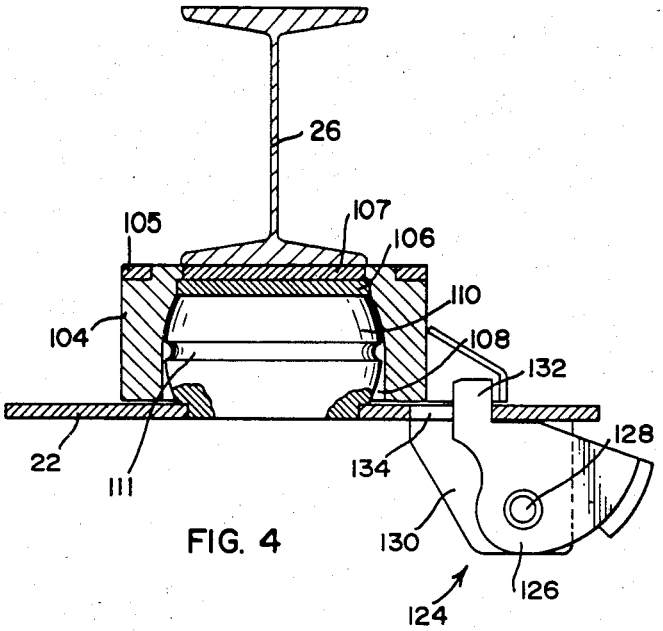
FIG. 4 is a schematic cross-sectional side view of the upper portion of the split bogie part of FIG. 3.
Figure 5:
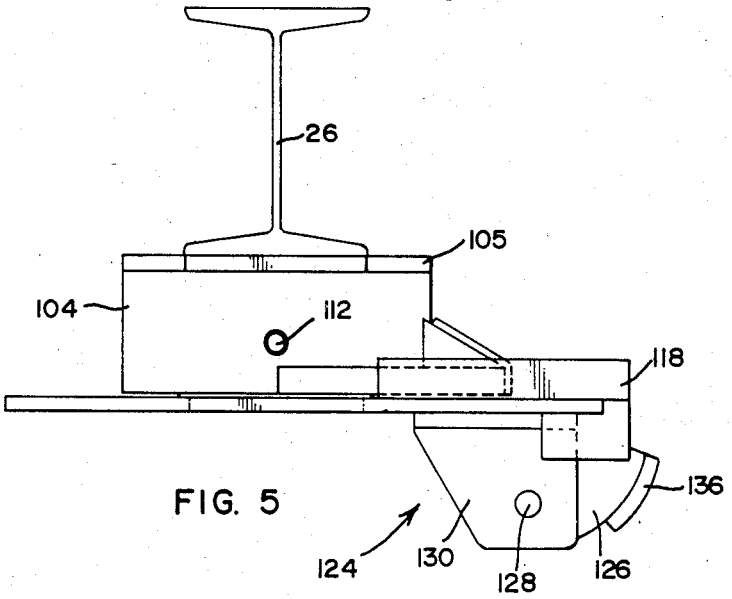
FIG. 5 is a schematic side view of the portion shown in FIG. 4.

Referring firstly to FIGS. 1 and 2, a hopper car 10 is formed primarily from steel and comprises a chassis 12, a hopper body 14 defining a hopper cavity, and a door 16. The chassis is in the form of a chassis frame having longitudinally extending beams 24, transverse end beams 26, and suitably rigid spacer members 25 welded to and connecting these beams. The arrangement is such that the beams 24 are much lower than the beams 26.

Two wheel sets each including wheel bearings 18, are mounted in a suitable manner beneath the respective beams 26 and receive axles 27 which mount flanged wheels 20 having rail-engaging surfaces, laterally outwardly of their flanges. The wheels are located partly between the beams 24. A series of supports (not shown) extends upwardly from the chassis frame and supports the body.

The body comprises laterally spaced side walls 28 and 30 fixed on the chassis, and also two end walls 32. The side wall 28 includes a sloping wall 34 and a lower vertical wall in the form of strip 34.1 with a lower edge 36. The vertical wall 38 extends upwardly from the sloping wall 34. The side wall 30 has a vertical wall 40 which is parallel to and spaced laterally from the vertical wall 38, a further sloping wall 42 sloping upwardly from a lower vertical wall in the form of strip 42.1 with a lower edge 43, and an intermediate wall 44 which is between the walls 40 and 42, and is inclined at a relatively steep angle compared to the wall 42. The walls can be designed to reduce the height of or avoid the strips 34.1 and 42.1, if desired. The walls are strengthened by the stiffeners mentioned above, where necessary. The edges 36 and 43 and the lower edges of the end walls 32 borders an opening at the bottom of the hopper cavity.

The width of the opening is greater than the spacing between the wheels in each wheel set, and the length of the opening is slightly less than the longitudinal distance between the wheels at each side of the rail car.

In order to keep the centre of gravity of the loaded hopper suitably lower for any particular load, the bottom of the hopper cavity is located as low as is considered to be practical. As shown in FIG. 2, the bottom of the hopper cavity is at the position of the door opening and is below the level of the beams 26. It is also below the level of the tops of the wheels 20, but above the bottoms of the wheels and the rails. This arrangement is facilitated by locating the beams 24 well below the level of the beams 26 and largely at a level alongside the lower parts of the wheels 20, and by locating the wheel sets close to the ends of the hopper. As shown in FIG. 1, the wheels even project beyond the longitudinal ends of the chassis frame. The door is shaped and pivoted to swing above a respective beam 24 and to move through an arc passing between the respective wheels.

More specifically, the door 16 is capable of swinging between the positions illustrated at 16.1 and 16.2 in FIG. 2. To permit this movement to take place, while still providing some support for the hopper body on this side of the car, two vertically elongated end supports 46 of I-section are provided. The supports 46 extend upwardly from the chassis 12 and are secured to the walls 32, the supports being omitted from FIG. 2 in the interest of clarity.

The door 16 has two end plates 50 which are carried pendulum-fashion by trunnions 52 secured to supports 46 and end walls 32, the trunnions 52 mounting the end plates 50 between the supports 46 and the end walls 32 of the hopper body.

The door 16 further includes a curved base plate 54 (the concave face of the base plate being uppermost) which extends between and is secured to the end plates 50. The base plate 54 is strengthened by a pair of channels 56 which extends downwardly from the underside thereof. One of the longitudinal edges 55 of the base plate 54 is turned downwardly, which also enhances its strength.

Centrally of the door, the door is provided with two curved, parallel, transversely extending stiffeners 58. A pivot pin 60 is mounted on the stiffeners 58, and the pin 60 pivotally mounts an arm 62. The arm has a roller 64 rotatably mounted at its outer end.

The upper face of the arm 62 is shown at 66 and, in the closed position of the door, is spaced from the turned-down longitudinal edge 55 of the door. The lower side of the edge 55 constitutes an abutment surface, and the face 62 of the arm constitutes a complementary abutment face. Thus, when the roller 64 encounters a suitable tipping arm, the outer end of the arm 62 is lifted and there is some lost motion between the arm 62 and the door 16. The arm 62 pivots about the pin 60 with respect to the door 16 until the gap between the edge 55 and the arm has been taken up. Thereafter, further swinging movement of the arm 62 in an upward direction causes the door to move towards the position 16.2, the arm 62 remaining in engagement with the edge 55. As the door opens, discharge of material takes place between the beams 24.

The arm 64 has a stepped undersurface provided with a shoulder 68 for sitting adjacent to a complementary shoulder 70 on the beam 24 in the closed condition of the door. The relationship between the shoulder 68 and the shoulder 70 is such that, in the closed condition of the door, lateral movement of the arm and door towards the open position is prevented. However, during upward lost motion of the arm 62 with respect to the door edge 55, the shoulder 68 clears the shoulder 70 so that the shoulders are clear of one another by the time that the arm lifts the door in its upward swinging movement.

During subsequent closing movement of the door, the door and arm swing downwardly together until the door reaches its fully closed position. Thereafter, the arm moves downwardly and away from the door, and the shoulders are re-located.

To ensure that those portions of the door which are in sealing engagement with the lower edges of the walls 28 and 30 when the door is closed do not simply swing laterally with respect thereto, the axis of curvature of the base plate 54 of the door may be offset horizontally with respect to the axis of the trunnions 52. The movement of the base plate 54 may then include a slightly downward component with respect to the lower edges of the walls 28 and 30 to reduce the possibility of ore wedging the door solidly to the body.

Because of the curvature of the door and the manner in which the door is made, mounted and pivoted, the door clears the beam 24 and wheels 22 as it pivots.

As will be seen from FIG. 1, the upper ends of the end walls 32 of the hopper body are provided with diverging guide walls 82 and 84, which constitute overhanging portions of the body. The guide wall 82 terminates in a downwardly directed lip 86 while the wall 84 terminates in a downwardly directed lip 88. The walls 82 and 84 are such that, when two hopper cars are coupled end-to-end in a train, the wall 84 and its lip 88 overhang the wall 82 and its lip 86. Thus, when the car is filled by moving under a continuous discharge of ore or the like, the overhanging walls 82 and 84 help to ensure that material will not be dumped between the cars onto the track.

When the hopper cars negotiate a bend in the track, the laterally outer ends of the wall 82 move one forwardly and one rearwardly with respect to the overhanging wall 84, and walls 82 and 84 are shaped and located to prevent engagement of one with the other.

The wheel sets of the hopper shown in FIG. 1 may each form part of a split bogie assembly like that shown in FIGS. 3 to 8.

Each of these split bogie assemblies includes a pair of complementary bogie parts 100 and 102 mounted at opposite ends of each hopper. Each bogie part includes a bogie saddle 104 fixed beneath a respective transverse beam 26 of the hopper and located by an upper plate 105. A wear-resistant disc 106 is located in a partially spherical socket 108 of each bogie saddle beneath a central disc 107 and is engaged by a flat upper surface of a bogie turntable member 110. Each member 110 has a partially spherical surface which is complementary to the inner surface of the socket 108. The member 110 is secured in the respective saddle by a suitable retaining pin 112 projecting into an annular groove 111 in member 110.

Bogie base plates 22 are fixed to the members 110 and can pivot with respect to the saddles 104 as the members 110 pivot in the sockets 108. Each of the bogie base plates 22 is fixed to the wheel bearings 18 of the respective wheel set, as shown in FIG. 2.

The base plates 22 are provided with complementary female formations 114 and male formations 116 towards edge regions of the base plates, and these formations have wear strips 118 along their edges. There is a slight clearance between the plates 118 when coupled hoppers provided with the base plates are moving in a straight line, as in FIG. 5. However, the axes of rotation 120 of the wheels of adjacent wheel sets (shown schematically in FIG. 7) may converge and meet at an axis (which is preferably as close as possible to the centre of curvature of a curve in the track 122) when the hoppers move around the curve. The strips 118 of the formations may then slidingly engage, as shown schematically in FIG. 8, to constrain the movement of the plates 22 and to ensure that the movement of the base parts is co-ordinated.

In order to restrict pivotal movement of the base plates 22 with respect to the beams 26 of the respective hoppers when the hoppers are uncoupled, each bogie part is provided with a catch arrangement 124 including a locking crank 126 mounted on a respective pin 128 between mounting plates 130. Each crank has a locking formation 132 for engaging in a slot 134 of the respective pin 128 between mounting plates 130. Each crank has a locking formation 132 for engaging in a slot 134 of the respective base plate 22 for preventing pivoting of the base plate when it is located in the slot. The crank is designed so that its mass is primarily to the opposite side of the pin 128 to the formation 134, so that the formation 132 is normally biassed by gravity into the slot 134 when the hopper cars are not coupled together.

Each crank is also provided with a curved cam plate 136 for engaging a cam plate of an adjacent bogie part when two hoppers are coupled together, the engagement of the cam plates causing pivoting of the cranks 126 and causing formations 132 to move out of the slots, thus permitting pivotal movement of the base plates 22 with respect to the beams 26.

Figure 6:
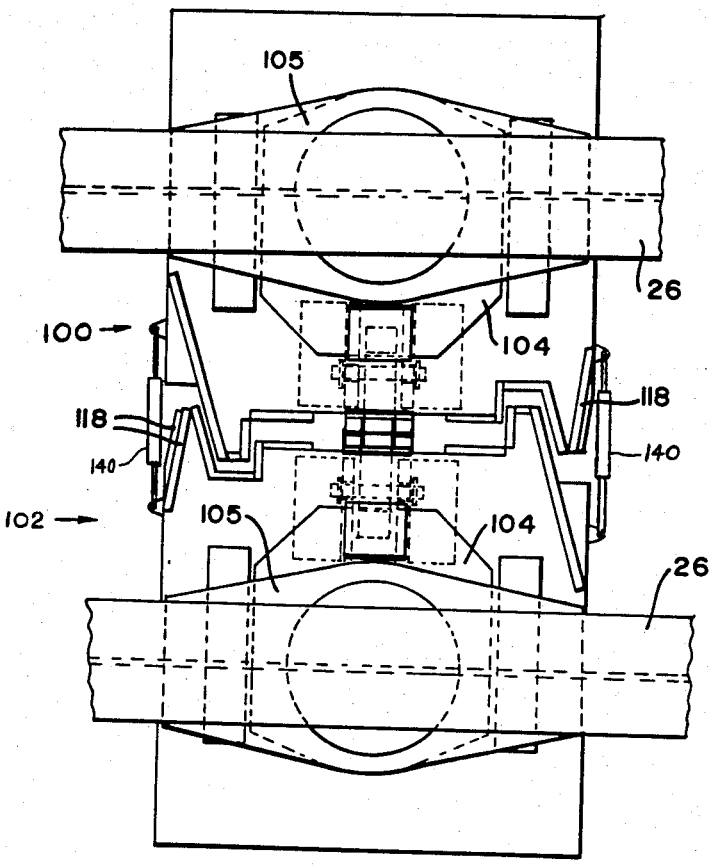
FIG. 6 is a plan view showing the upper portions of two split bogies, in use on a straight track.
Figure 7:
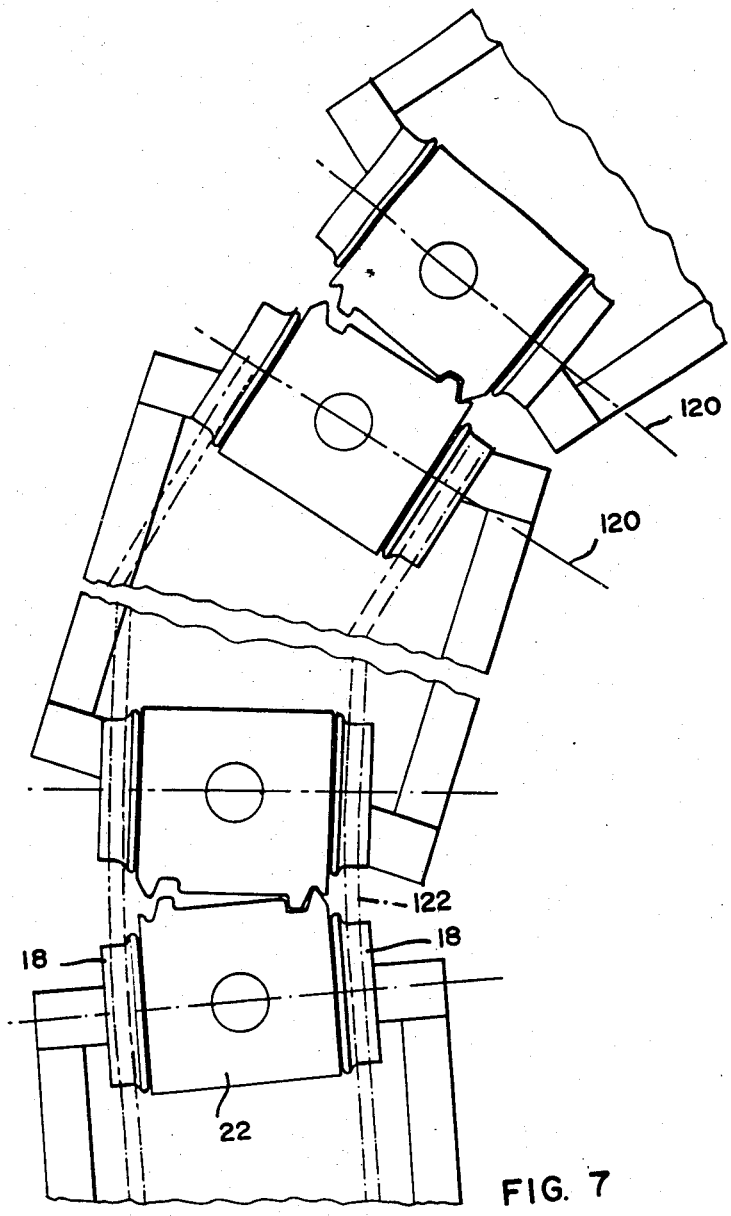
FIG. 7 is a schematic underplan view showing hopper cars of a train negotiating a curve in the track.
Figure 8:
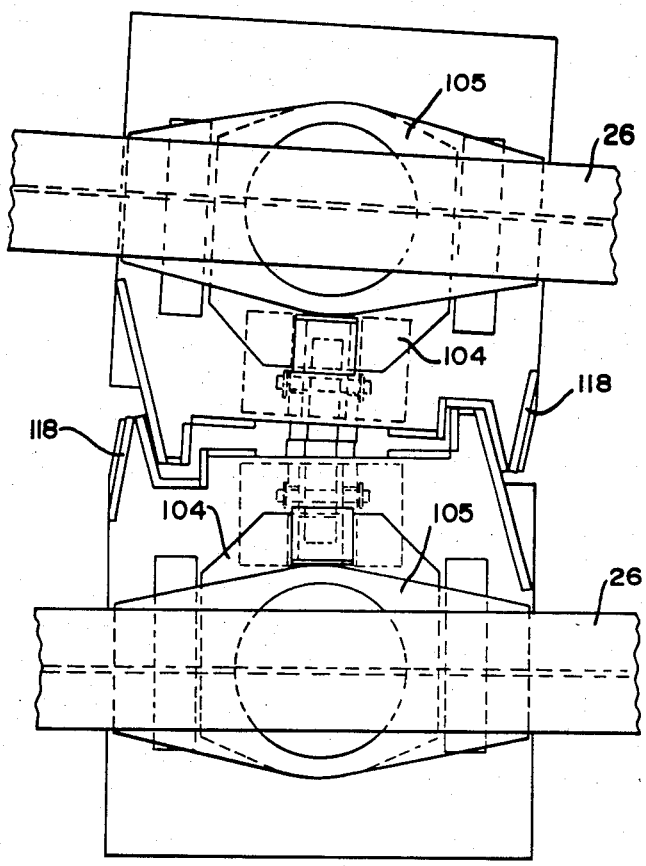
FIG. 8 is a view similar to FIG. 6, but showing the assembly negotiating a curve.

It is found that the freedom of movement between the bogie parts is excessive, particularly when the plates 118 are not in engagement, the hoppers may have suitable means for co-ordinating movement of the parts at those times, such as hydraulic dampers 140 (FIG. 6).

I claim:

1. A split bogie assembly having bogie parts each pivotally mounted at an end region of a respective rail car and each including a pair of flanged wheels rotatable about a common axis, the bogie parts being mounted adjacent to one another and each having means for co-operating with complementary means on the other bogie part for co-ordinating movement of the bogie parts of the assembly with respect to one another at least when the assembly moves along a suitable curved track, in use;

the co-operating means and the complementary co-operating means each comprising formations at adjacent edge regions of the bogie parts;

the assembly including locking means for preventing undue pivoting movement of the bogie parts when when said rail cars and their respective bogie parts are uncoupled from one another.

2. A bottom discharge hopper rail car train including at least two hopper rail cars each having a hopper body mounted on a chassis, adjacent ends of said two hopper rail cars being supported by a split bogie assembly having bogie parts each pivotally mounted at an end region of a respective rail car and each including a pair of flanged wheels rotatable about a common axis, the bogie parts being mounted adjacent to one another and each having means for co-operating with complementary means on the other bogie part for co-ordinating movement of the bogie parts of the assembly with respect to one another at least when the assembly moves along a suitable curved track, in use;

the co-operating means and the complementary co-operating means each comprising formations at adjacent edge regions of the bogie parts;

the assembly including locking means for preventing undue pivoting movement of the bogie parts when when said hopper rail cars and their respective bogie parts are uncoupled from one another.

3. A rail car train according to claim 2, wherein said at least two hopper rail cars each have a body with transversely and longitudinally extending edges which border a discharge opening from the body, the opening being wholly or substantially wholly at a level below the tops of the wheels but above the bottoms of the wheels.

4. A rail car train according to claim 3, wherein at least one door is pivotally mounted on the body and displaceable between a closed condition in which said opening is closed by said at least one door, and an open condition to permit discharge of the contents of said body.

5. A rail car according to claim 3, wherein the longitudinally extending edges of each body are at the lower region of a pair of downwardly converging laterally spaced side walls which are asymmetrical with respect to a longitudinal vertical plane passing centrally between the wheels.

6. A rail car train according to claim 5, wherein these longitudinal edges of each body are below the tops of the wheels but are located one above the other, allowing a single door to be asymetrically mounted on the body.

7. A rail car train according to claim 3, wherein the distance between the longitudinally extending edges of each body is greater than the spacing between wheels at opposite sides of the rail car measured in a direction across the width of the car.

8. A rail car train according to claim 2, wherein each bogie part is pivotally mounted at its respective end region of the respective rail car by means of a bogie saddle and complementary bogie member pivotally associated therewith.

9. A rail car train according to claim 2, wherein the chassis of each rail car is formed wholly or primarily by a chassis frame supporting the body, and the wheels of that rail car project beyond the ends of the chassis frame.

* * * * *